US011636962B2

(12) United States Patent
Miwa et al.

(10) Patent No.: US 11,636,962 B2
(45) **Date of Patent: *Apr. 25, 2023**

(54) R-T-B BASED PERMANENT MAGNET

(71) Applicant: TDK Corporation, Tokyo (JP)

(72) Inventors: Masashi Miwa, Tokyo (JP); Koji Miura, Tokyo (JP); Taeko Tsubokura, Tokyo (JP)

(73) Assignee: TDK Corporation, Tokyo (JP)

( * ) Notice: Subject to any disclaimer, the term of this patent is extended or adjusted under 35 U.S.C. 154(b) by 116 days.

This patent is subject to a terminal disclaimer.

(21) Appl. No.: 17/202,410

(22) Filed: Mar. 16, 2021

(65) Prior Publication Data

US 2021/0313099 A1 Oct. 7, 2021

(30) Foreign Application Priority Data

Mar. 26, 2020 (JP) ..... JP2020-056469

(51) Int. Cl.
*H01F 1/057* (2006.01)
*B22F 3/16* (2006.01)
(Continued)

(52) U.S. Cl.
CPC ..... *H01F 1/0571* (2013.01); *B22F 3/16* (2013.01); *B22F 9/04* (2013.01); *C22C 28/00* (2013.01);
(Continued)

(58) Field of Classification Search
CPC ..... H01F 41/0293; H01F 1/0571; H01F 1/0577; H01F 1/057; H01F 1/0572;
(Continued)

(56) References Cited

U.S. PATENT DOCUMENTS

2013/0026870 A1 1/2013 Baba et al.
2017/0365384 A1* 12/2017 Hirota ..... C22C 38/06
(Continued)

FOREIGN PATENT DOCUMENTS

WO WO-2011/122667 A1 10/2011

OTHER PUBLICATIONS

U.S. Office Action dated May 23, 2022 issued in U.S. Appl. No. 17/202,424.

*Primary Examiner* — Michael E. La Villa
(74) *Attorney, Agent, or Firm* — Faegre Drinker Biddle & Reath LLP

(57) ABSTRACT

Provided is a permanent magnet including a rare-earth element R, a transition metal element T, B, Zr, and Cu. The permanent magnet contains main phase grains including Nd, T, and B, and grain boundary multiple junctions, the grain boundary multiple junction is a grain boundary surrounded by three or more of the main phase grains, one of the grain boundary multiple junctions contains a $ZrB_2$ crystal and an R—Cu-rich phase, a concentration of B in the grain boundary multiple junction containing both the $ZrB_2$ crystal and the R—Cu-rich phase is from 5 to 20 atomic %, a concentration of Cu in the grain boundary multiple junction containing both the $ZrB_2$ crystal and the R—Cu-rich phase is from 5 to 25 atomic %, and a surface layer part of the main phase grain includes at least one kind of heavy rare-earth element among Tb and Dy.

6 Claims, 6 Drawing Sheets

(51) Int. Cl.

| | |
|---|---|
| ***B22F 9/04*** | (2006.01) |
| ***C22C 38/00*** | (2006.01) |
| ***C22C 28/00*** | (2006.01) |
| ***C22C 33/02*** | (2006.01) |
| ***C22C 38/06*** | (2006.01) |
| ***C22C 38/10*** | (2006.01) |
| ***C22C 38/16*** | (2006.01) |
| ***C22C 38/14*** | (2006.01) |
| *H01F 41/02* | (2006.01) |

(52) U.S. Cl.

CPC ..... *C22C 33/0285* (2013.01); *C22C 38/00* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 1/057* (2013.01); *H01F 1/0572* (2013.01); *H01F 1/0577* (2013.01); *B22F 2202/05* (2013.01); *B22F 2301/45* (2013.01); *B22F 2998/10* (2013.01); *B22F 2999/00* (2013.01); *C22C 2202/02* (2013.01); *H01F 41/0293* (2013.01)

(58) Field of Classification Search

CPC ..... B22F 2301/45; B22F 3/16; B22F 3/02; B22F 3/10; B22F 9/04; B22F 2202/05; B22F 2999/00; B22F 2998/10; B22F 2998/00; B22F 2003/248; C22C 28/00; C22C 33/0285; C22C 38/002; C22C 38/005; C22C 38/06; C22C 38/10; C22C 38/16; C22C 38/00; C22C 38/14; C22C 2202/02

See application file for complete search history.

(56) References Cited

U.S. PATENT DOCUMENTS

2018/0218835 A1* 8/2018 Jang ..... H01F 1/0577
2021/0304929 A1* 9/2021 Miwa ..... C22C 38/16

* cited by examiner

R-T-B BASED PERMANENT MAGNET

TECHNICAL FIELD

The present disclosure relates to an R-T-B based permanent magnet.

BACKGROUND

The R-T-B based permanent magnet including a rare-earth element R (such as Nd), a transition metal element T (such as Fe), and boron (B) is a nucleation type permanent magnet. When a magnet field opposite to a magnetization direction is applied to the nucleation type permanent magnet, a magnetization reversal nucleus is likely to occur near a grain boundary of a plurality of crystal grains (main phase grains) which constitute the permanent magnet. In addition, since the magnetization reversal of the crystal grains proceeds from the magnetization reversal nucleus, coercivity of the R-T-B based permanent magnet tends to be low.

To increase the coercivity of the R-T-B based permanent magnet, a heavy rare-earth element such as Dy is added to the R-T-B based permanent magnet. Due to addition of the heavy rare-earth element, an anisotropic magnetic field is likely to increase, and the magnetization reversal nucleus is less likely to occur near the grain boundary, and thus the coercivity (HcJ) increases. However, since the price of the heavy rare-earth element is high, it is desired to reduce a content of the heavy rare-earth elements in the R-T-B based permanent magnet to reduce the manufacturing cost of the R-T-B based permanent magnet.

For example, an R-T-B based sintered magnet described in Pamphlet of International Publication WO 2011/122667 contains a plurality of main phase grains having a core and a shell covering the core, the thickness of the shell is 500 nm or less, R includes a light rare-earth element and a heavy rare-earth element, and a Zr compound exists in at least one of a grain boundary phase and the shell.

SUMMARY

An object of an aspect of the invention is to provide an R-T-B based permanent magnet having high coercivity.

According to an aspect of the invention, there is provided an R-T-B based permanent magnet including a rare-earth element R, a transition metal element T, B, Zr, and Cu. The R-T-B based permanent magnet includes at least Nd as R, the R-T-B based permanent magnet includes at least Fe as T, the R-T-B based permanent magnet contains a plurality of main phase grains including Nd, T, and B, and a plurality of grain boundary multiple junctions, the one grain boundary multiple junction is a grain boundary surrounded by three or more of the main phase grains, any one of the grain boundary multiple junctions contains both a $ZrB_2$ crystal and an R—Cu-rich phase including R and Cu, a concentration of B in the one grain boundary multiple junction containing both the $ZrB_2$ crystal and the R—Cu-rich phase is from 5 to 20 atomic %, a concentration of Cu in the one grain boundary multiple junction containing both the $ZrB_2$ crystal and the R—Cu-rich phase is from 5 to 25 atomic %, and a surface layer part of the main phase grain includes at least one kind of heavy rare-earth element among Tb and Dy.

A concentration of Zr in the one grain boundary multiple junction containing both the $ZrB_2$ crystal and the R—Cu-rich phase may be from 1 to 10 atomic %.

A total concentration of Nd and Pr in the one grain boundary multiple junction containing both the $ZrB_2$ crystal and the R—Cu-rich phase may be from 20 to 70 atomic %.

The R—Cu-rich phase may exist around the $ZrB_2$ crystal.

The R—Cu-rich phase may exist between the $ZrB_2$ crystal and the main phase grain.

Some of the grain boundary multiple junctions may contain a T-rich phase including T, Cu, and at least one kind of R among Nd and Pr, a concentration of T in the grain boundary multiple junction containing the T-rich phase may be higher than a concentration of T in the other grain boundary multiple junction, and a unit of the concentration of T may be atomic %.

According to an aspect of the invention, an R-T-B based permanent magnet having high coercivity is provided.

DETAILED DESCRIPTION

Figure 1A:
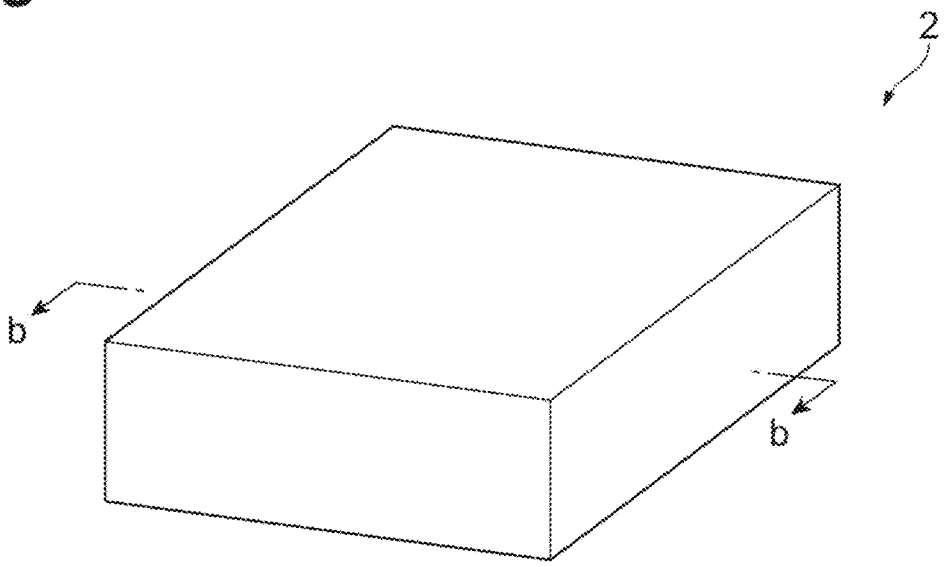
FIG. 1A is a schematic perspective view of an R-T-B based permanent magnet according to an embodiment of the invention.

Hereinafter, a preferred embodiment of the invention will be described with reference to the accompanying drawings. In the drawings, an equivalent reference numeral will be given to an equivalent constituent element. The invention is not limited to the following embodiment. In the following description, "permanent magnet" represents an R-T-B based permanent magnet. In the following description, a unit of a concentration of each element is atomic %.

(Permanent Magnet)

The permanent magnet according to this embodiment includes at least a rare-earth element (R), a transition metal element (T), boron (B), zirconium (Zr), and copper (Cu). The permanent magnet according to this embodiment may be a sintered magnet.

The permanent magnet includes at least neodymium (Nd) as the rare-earth element R. The permanent magnet may further include another rare-earth element R in addition to Nd. The other rare-earth element R included in the permanent magnet may be least one kind selected from the group consisting of scandium (Sc), yttrium (Y), lanthanum (La), cerium (Ce), praseodymium (Pr), samarium (Sin), europium (Eu), gadolinium (Gd), terbium (Tb), dysprosium (Dy), holmium (Ho), erbium (Er), thulium (Tm), ytterbium (Yb), and lutetium (Lu).

The permanent magnet includes at least iron (Fe) as the transition metal element T. The permanent magnet may include only Fe as the transition metal element T. The permanent magnet may include both Fe and cobalt (Co) as the transition metal element T.

Figure 1B:
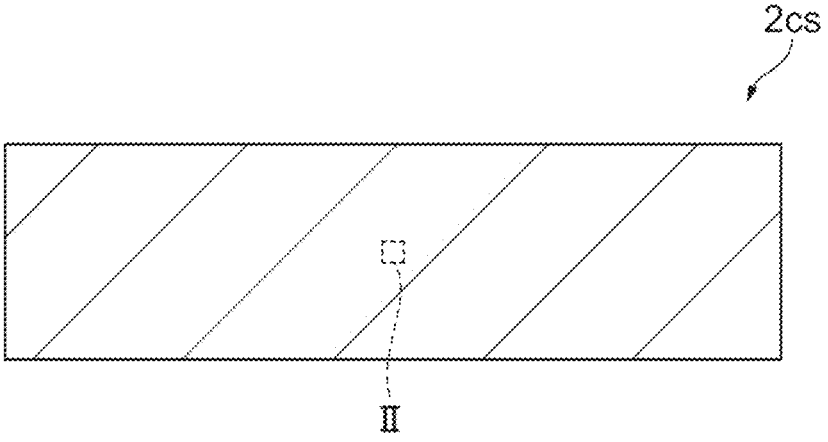
FIG. 1B is a schematic view (an arrow view in a direction of line b-b) of a cross-section of the R-T-B based permanent magnet illustrated in FIG. 1A.

FIG. 1A is a perspective view of a rectangular parallelepiped permanent magnet 2 according to this embodiment. FIG. 1B is a schematic view of a cross-section 2*cs* of the permanent magnet 2. The shape of the permanent magnet 2 is not limited to a rectangular parallelepiped. For example, the shape of the permanent magnet 2 may be a cube, a rectangle (plate), a polygonal column, an arc segment, a fan, an annular sector shape, a sphere, a disk, a circular column, a tube, a ring, or a capsule. The shape of the cross-section 2*cs* of the permanent magnet 2 may be, for example, a polygon, a circular arc (circular chord), a bow shape, an arch shape, a C-shape, or a circle.

Figure 2:
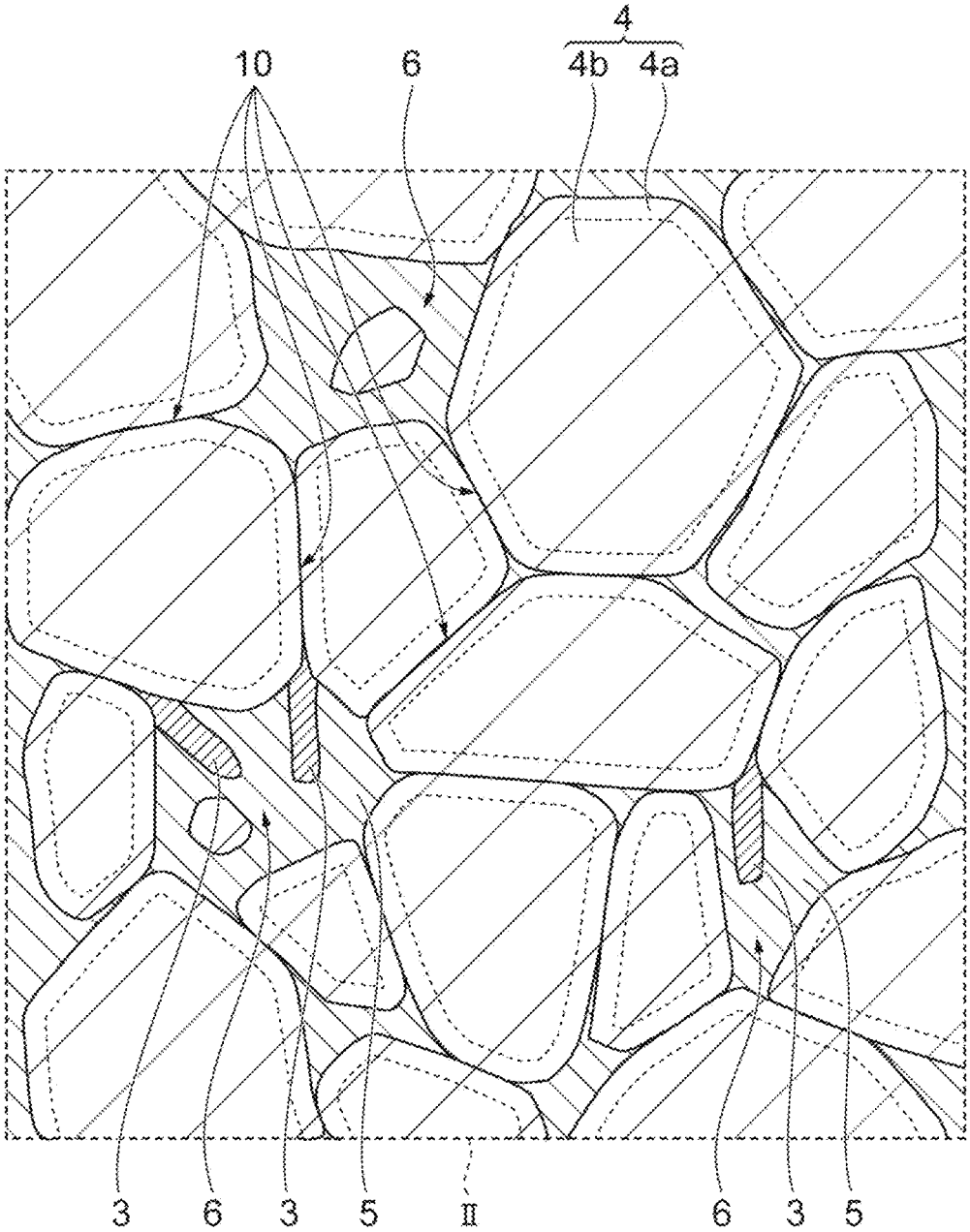
FIG. 2 is an enlarged view of a part (Region II) of the cross-section illustrated in FIG. 1B.

FIG. 2 is an enlarged view of a part (Region II) of the cross-section 2*cs* illustrated in FIG. 1B. As illustrated in FIG. 2, the permanent magnet 2 contains a plurality of main phase grains 4. Each of the main phase grains 4 includes at least Nd, T, and B. The main phase grain 4 may contain an $R_2T_{14}B$ crystal (a single crystal or a polycrystal). The main phase grain 4 may include another element in addition to Nd, T, and B. For example, $R_2T_{14}B$ may be expressed by $(Nd_{1-x}Pr_x)_2(Fe_{1-y}Co_y)_{14}B$. x may be 0 or more and less than 1. y may be 0 or more and less than 1. The main phase grain 4 may include a heavy rare-earth element such as Tb and Dy as R in addition to a light rare-earth element. The main phase grain 4 may further include Zr. A part of B in $R_2T_{14}B$ may be substituted with carbon (C). A composition in the main phase grain 4 may be uniform. The composition in the main phase grain 4 may be non-uniform. For example, a concentration distribution of each of R, T, and B in the main phase grain 4 may have a gradient.

The main phase grain 4 is composed of a surface layer part 4*a* and a center part 4*b* covered with the surface layer part 4*a*. The surface layer part 4*a* may be referred to as a shell, and the center part 4*b* may be referred to as a core. The surface layer part 4*a* of the main phase grain 4 includes at least one kind of heavy rare-earth element among Tb and Dy. The surface layer part 4*a* of each of the all main phase grains 4 may include at least one kind of heavy rare-earth element among Tb and Dy. The surface layer part 4*a* of some main phase grains 4 among all of the main phase grains 4 may include at least one kind of heavy rare-earth element among Tb and Dy. When the surface layer part 4*a* includes the heavy rare-earth element, an anisotropic magnetic field is likely to increase locally near a grain boundary, and a magnetization reversal nucleus is less likely to occur near the grain boundary. As a result, coercivity of the permanent magnet 2 at a high temperature increases. The high temperature may be, for example, from 100 to 200° C. From the viewpoint that the residual magnetic flux density and the coercivity of the permanent magnet 2 are likely to be compatible with each other, a total concentration of the heavy rare-earth elements in the surface layer part 4*a* may be higher than a total concentration of the heavy rare-earth elements in the center part 4*b*.

The permanent magnet 2 contains a grain boundary located between the main phase grains 4. The permanent magnet 2 contains a plurality of grain boundary multiple junctions 6 as a grain boundary. The grain boundary multiple junction 6 is a grain boundary surrounded by three or more main phase grains 4. In addition, the permanent magnet 2 contains a plurality of two-grain boundaries 10 as the grain boundary. The two-grain boundary 10 is a grain boundary located between two adjacent main phase grains 4.

Any one of the grain boundary multiple junctions 6 contains both a zirconium boride ($ZrB_2$) crystal 3 and an R—Cu-rich phase 5 including R and Cu. Hereinafter, the one grain boundary multiple junction 6 containing both the $ZrB_2$ crystal 3 and the R—Cu-rich phase 5 may be noted as "Zr—B—R—Cu grain boundary".

Figure 3:
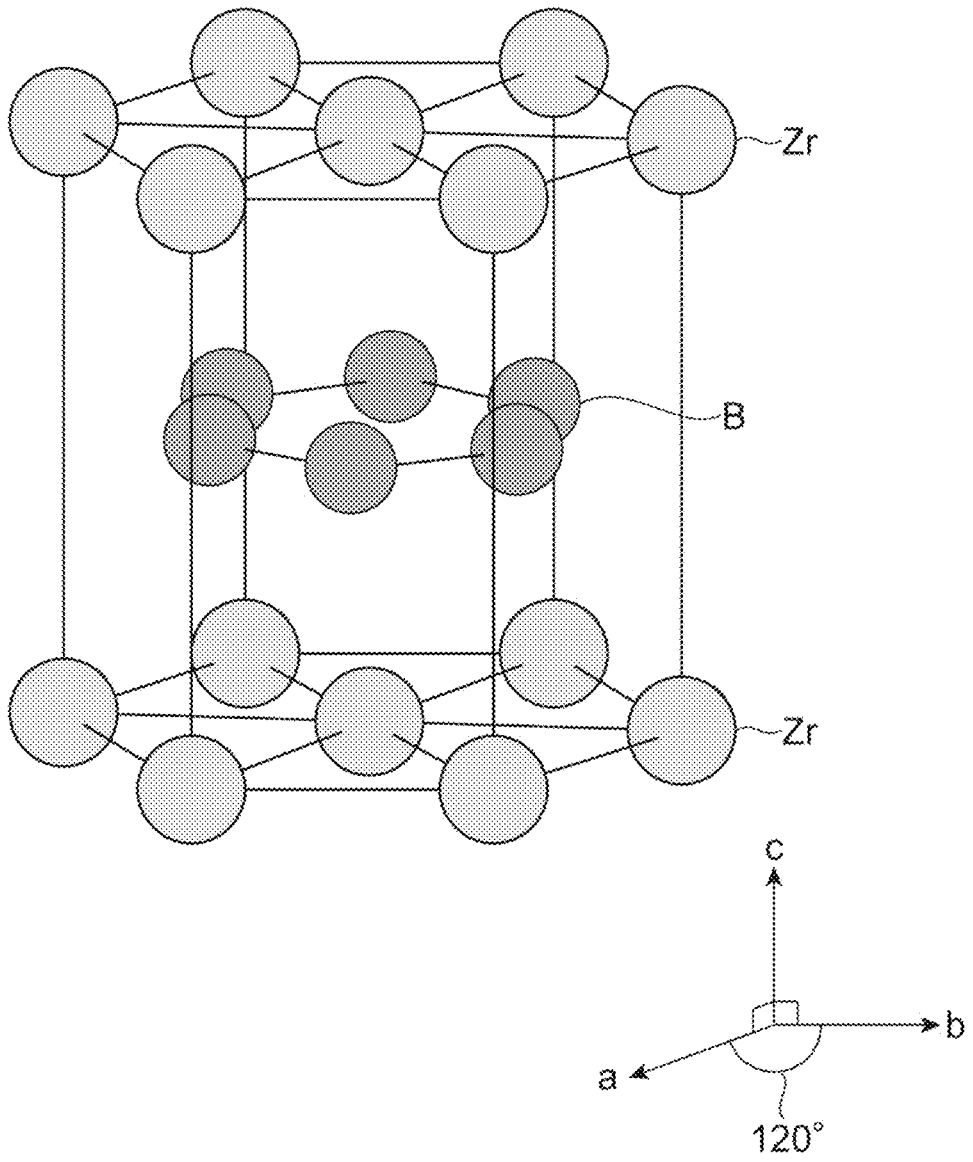
FIG. 3 is a perspective view of a crystal structure of $ZrB_2$.

FIG. 3 illustrates a crystal structure of the $ZrB_2$ crystal 3. In FIG. 3, each of an a-axis, a b-axis, and a c-axis is a crystal axis of $ZrB_2$. An angle between the a-axis and the b-axis is 120°. The a-axis and the b-axis are orthogonal to the c-axis. The crystal structure of $ZrB_2$ has rotational symmetry with respect to the c-axis, and is six-fold symmetric. That is, the $ZrB_2$ crystal 3 is a hexagonal system, and a three-dimensional space group of the $ZrB_2$ crystal 3 is P6/mmm.

A concentration of B in the one Zr—B—R—Cu grain boundary is from 5 to 20 atomic %. The concentration of B in the one Zr—B—R—Cu grain boundary is higher than an average value of a concentration of B in the cross-section 2*cs* of the permanent magnet 2.

A concentration of Cu in the one Zr—B—R—Cu grain boundary is from 5 to 25 atomic %. The concentration of Cu in the one Zr—B—R—Cu grain boundary is higher than an average value of a concentration of Cu in the cross-section 2*cs* of the permanent magnet 2.

The one grain boundary multiple junction 6 where the concentration of each of B and Cu is within the above-described range is likely to contain both the $ZrB_2$ crystal 3 and the R—Cu-rich phase 5. From the same reason, a concentration of B in one Zr—B—R—Cu grain boundary may be from 6.4 to 15.2 atomic %, and a concentration of Cu in the one Zr—B—R—Cu grain boundary may be from 9.2 to 19.6 atomic %.

A total concentration of Nd and Pr in the one Zr—B—R—Cu grain boundary may be higher than a total concentration of Nd and Pr in the main phase grain 4. A concentration of Cu in the one Zr—B—R—Cu grain boundary may be higher than a concentration of Cu in the main phase grain 4. The R—Cu-rich phase 5 may be a grain boundary phase contained in the grain boundary multiple junction 6 where a total concentration of Nd and Pr is higher than a total concentration of Nd and Pr in the main phase grain 4, and a concentration of Cu is higher than a concentration of Cu in the main phase grain 4. The total concentration of Nd and Pr in the main phase grain 4 may be an average value of a total concentration of Nd and Pr in all of the main phase grains 4 which are in contact with the one Zr—B—R—Cu grain boundary. The concentration of Cu in the main phase grain 4 may be an average value of a concentration of Cu in all of the main phase grains 4 which are in contact with the one Zr—B—R—Cu grain boundary.

A concentration of Zr in the one Zr—B—R—Cu grain boundary may be from 1 to 10 atomic % or from 1.6 to 7.4 atomic %. The concentration of Zr in the one Zr—B—R—Cu grain boundary is higher than an average value of a concentration of Zr in the cross-section 2*cs* of the permanent magnet 2.

A total concentration of Nd and Pr in the one Zr—B—R—Cu grain boundary may be from 20 to 70 atomic %, or from 25.1 to 46.1 atomic %.

The concentration of each of Zr, Nd, and Pr in the one Zr—B—R—Cu grain boundary tends to be within the above-described range. In other words, the one grain boundary multiple junction 6 where the concentration of each of Zr, Nd, and Pr is within the above-described range is likely to contain both the $ZrB_2$ crystal 3 and the R—Cu-rich phase 5.

The permanent magnet 2 may contain a plurality of the Zr—B—R—Cu grain boundaries. Some grain boundary multiple junctions 6 among all of the grain boundary multiple junctions 6 contained in the permanent magnet 2 may not be the Zr—B—R—Cu grain boundary. For example, some grain boundary multiple junctions 6 may contain only the $ZrB_2$ crystal 3. Some grain boundary multiple junctions 6 may contain only the R—Cu-rich phase 5. Some grain boundary multiple junctions 6 may not contain any of the $ZrB_2$ crystal 3 and the R—Cu-rich phase 5.

The Zr—B—R—Cu grain boundary is formed by a sintering step and a diffusing step to be described later. The diffusing step is performed after the sintering step. In the sintering step, a magnet base material (sintered body) is obtained by heating a green compact formed from an alloy powder. In the diffusing step, a diffusing material is caused to adhere to a surface of the magnet base material, and the magnet base material to which the diffusing material adheres is heated. The diffusing material includes a first component including at least one kind of R (light rare-earth element) among Nd and Pr, a second component including Cu, and a third component including at least one kind of heavy rare-earth element among Tb and Dy.

In the sintering step, in accordance with sintering of respective alloy particles which constitute the alloy powder, $ZrB_2$ derived from Zr and B in the alloy particles is generated in the grain boundary multiple junction 6. In addition, in the sintering step, a grain boundary phase (R phase) in which a concentration of R (light rare-earth element such as Nd) is high is formed in the grain boundary multiple junction 6 and the two-grain boundary 10. R in the R phase is derived from the alloy particles. In accordance with temperature rising in the diffusing step subsequent to the sintering step, the R phase existing in the grain boundary multiple junction 6 and the two-grain boundary 10 becomes a liquid phase (R liquid phase). When R (light rare-earth element such as Nd) and Cu in the diffusing material are dissolved in the R liquid phase, R and Cu in the diffusing material diffuse into the magnet from a surface of the magnet base material. As a result, a liquid phase (R—Cu-rich liquid phase) in which a concentration of each of R (light rare-earth element such as Nd) and Cu is high is formed in the grain boundary multiple junction 6. $ZrB_2$ is excellent in affinity for the R—Cu-rich liquid phase. That is, solubility of $ZrB_2$ in the R—Cu-rich liquid phase is high. Accordingly, in the diffusing step, $ZrB_2$ is likely to be dissolved in the R—Cu-rich liquid phase. Due to cooling (rapid cooling) after the diffusing step, the $ZrB_2$ crystal 3 re-deposits in the R—Cu-rich liquid phase, and the R—Cu-rich liquid phase solidifies to become the R—Cu-rich phase 5.

The heavy rare-earth element included in the surface layer part 4*a* of the main phase grain 4 is derived from a heavy rare-earth element in the diffusing material used in the diffusing step. The surface layer part 4*a* ($R_2Fe_{14}B$) of the main phase grain 4 is dissolved in the R—Cu-rich liquid phase in the diffusing step. In a process in which the surface layer part 4*a* re-deposits due to the cooling (rapid cooling) after the diffusing step, the surface layer part 4*a* receives the heavy rare-earth element in the R—Cu-rich liquid phase, and thus the surface layer part 4*a* including the heavy rare-earth element is formed. As described above, in the diffusing step, $ZrB_2$ dissolves in the R—Cu-rich liquid phase, and thus a concentration of B in the grain boundary multiple junction 6 (R—Cu-rich liquid phase) increases. The increase in the concentration of B in the R—Cu-rich liquid phase suppresses dissolution of the surface layer part 4*a* ($R_2Fe_{14}B$) into the R—Cu-rich liquid phase. Due to suppression of dissolution of the surface layer part 4*a* ($R_2Fe_{14}B$), the thickness of the surface layer part 4*a* re-depositing while receiving the heavy rare-earth element becomes thin. Since the heavy rare-earth element is concentrated in the thin surface layer part 4*a*, the concentration of the heavy rare-earth element in the surface layer part 4*a* increases. As a result, the coercivity of the permanent magnet 2 increases. The thickness of the surface layer part 4*a* in a direction orthogonal to the surface of the main phase grain 4 may be, for example, from 3 to 50 nm.

Due to the above-described reasons, the permanent magnet 2 according to this embodiment can have high coercivity at a high temperature. The high temperature may be, for example, from 100 to 200° C.

As described above, $ZrB_2$ dissolved in the R—Cu-rich liquid phase re-deposits in the R—Cu-rich liquid phase due to cooling (rapid cooling) after the diffusing step. In addition, the R—Cu-rich liquid phase has excellent wettability, and thus in the diffusing step, the R—Cu-rich liquid phase is likely to directly cover the surface of the main phase grain 4. Due to these reasons, the $ZrB_2$ crystal 3 is likely to be formed in the R—Cu-rich phase 5, and the R—Cu-rich phase 5 is likely to be formed between the $ZrB_2$ crystal 3 and the main phase grain 4. That is, the R—Cu-rich phase 5 may exist around the $ZrB_2$ crystal 3, and the R—Cu-rich phase 5 may exist between the $ZrB_2$ crystal 3 and the main phase grain 4. Lattice mismatching between the $ZrB_2$ crystal 3 and the main phase grain 4 or a lattice defect in an interface between the $ZrB_2$ crystal 3 and the main phase grain 4 is likely to be a magnetization reversal starting point (magnetization reversal nucleus). However, since the R—Cu-rich phase 5 is interposed between the $ZrB_2$ crystal 3 and the main phase grain 4, a site where the $ZrB_2$ crystal 3 is in direct contact with the main phase grain 4 is reduced. As a result, the magnetization reversal starting point is less likely to be generated between the $ZrB_2$ crystal 3 and the main phase grain 4, and the coercivity of the permanent magnet 2 is likely to increase.

The $ZrB_2$ crystal 3 may be connected to the two-grain boundary 10. When the Zr—B—R—Cu grain boundary contains the $ZrB_2$ crystal 3 connected to the two-grain boundary 10, the permanent magnet 2 is likely to have a high coercivity.

To form the Zr—B—R—Cu grain boundary by the above-described mechanism, it is necessary for the diffusing material to include the first component including at least one kind of R among Nd and Pr, the second component including Cu, and the third component including at least one kind of heavy rare-earth element among Tb and Dy. In a case where the diffusing material does not include the second component, it is difficult for sufficient R—Cu-rich liquid phase to be formed in the grain boundary multiple junction 6 in the diffusing step. As a result, it is difficult to form the Zr—B—R—Cu grain boundary by the above-described mechanism, and thus it is also difficult to concentrate the heavy rare-earth element in the thin surface layer part 4*a*.

The technical scope of the invention is not limited to the above-described mechanism relating to formation of the Zr—B—R—Cu grain boundary.

Some grain boundary multiple junctions 6 other than the Zr—B—R—Cu grain boundary may contain an R-rich phase (rare-earth element-rich phase). The R-rich phase is a grain boundary phase including at least one kind of R among Nd and Pr, and is a grain boundary phase contained in a grain boundary multiple junction where a total concentration of R is higher in comparison to other grain boundary multiple junction. The total concentration of R in one grain boundary multiple junction where the R-rich phase is contained is higher than an average value of a total concentration of R in the cross-section 2*cs* of the permanent magnet 2.

Some grain boundary multiple junctions 6 other than the Zr—B—R—Cu grain boundary may contain an R—O—C phase. The R—O—C phase is a grain boundary phase including at least one kind of R among Nd and Pr, oxygen (O), and C, and is a grain boundary phase contained in a grain boundary multiple junction where a concentration of each of O and C is higher in comparison to the other grain boundary multiple junction. The concentration of O in one grain boundary multiple junction where the R—O—C phase is contained is higher than an average value of a concentration of O in the cross-section 2*cs* of the permanent magnet 2. The concentration of C in one grain boundary multiple junction where the R—O—C phase is contained is higher than an average value of a concentration of C in the cross-section 2*cs* of the permanent magnet 2. Since water (for example, water vapor) in the atmosphere oxidizes the R-rich phase in the grain boundary, generation and storage of hydrogen, hydrogenation of the R-rich phase, and oxidation of an R hydride by water proceed in succession in the grain boundary. As a result, the permanent magnet 2 is corroded. On the other hand, the R—O—C phase is less likely to be oxidized by water in comparison to the R-rich phase. In addition, the R—O—C phase is less likely to store hydrogen in comparison to the R-rich phase. Accordingly, since the permanent magnet 2 contains the R—O—C phase, corrosion resistance of the permanent magnet 2 is improved.

Some grain boundary multiple junctions 6 other than the Zr—B—R—Cu grain boundary may contain an oxide phase. The oxide phase is a grain boundary phase including an oxide of at least one kind of R among Nd and Pr as a main component and is different from the R—O—C phase in a composition.

Some grain boundary multiple junctions 6 other than the Zr—B—R—Cu grain boundary may contain a T-rich phase (transition metal element-rich phase). The T-rich phase is a grain boundary phase including T, Cu, and at least one kind of R among Nd and Pr, and is a grain boundary phase contained in a grain boundary multiple junction where a total concentration of T is higher in comparison to other grain boundary multiple junction. T included in the T-rich phase may be only Fe. T included in the T-rich phase may be Fe and Co. A total concentration of T in one grain boundary multiple junction where the T-rich phase is contained is higher than a total concentration of T in the other grain boundary multiple junction. Even though the concentration of T in the T-rich phase is higher in comparison to other grain boundary phase, magnetization of the T-rich phase is relatively low. When the T-rich phase with low magnetization exists in at least one of the grain boundary multiple junctions 6 and the two-grain boundaries 10, magnetic coupling between the main phase grains 4 is likely to be decoupled. As a result, the coercivity of the permanent magnet 2 is likely to increase. The T-rich phase may further include gallium (Ga) in addition to R, T, and Cu.

One grain boundary multiple junction 6 may contain a plurality of grain boundary phases selected from the group consisting of the $ZrB_2$ crystal 3, the R—Cu-rich phase 5, the R-rich phase, the oxide phase, the R—O—C phase, and the T-rich phase. One two-grain boundary 10 may contain a plurality of grain boundary phases selected from the group consisting of the $ZrB_2$ crystal 3, the R—Cu-rich phase 5, the R-rich phase, the oxide phase, the R—O—C phase, and the T-rich phase.

Some Zr—B—R—Cu grain boundaries may further contain the other grain boundary phase described above in addition to the $ZrB_2$ crystal 3 and the R—Cu-rich phase 5. For example, some Zr—B—R—Cu grain boundaries may further contain the T-rich phase in addition to the $ZrB_2$ crystal 3 and the R—Cu-rich phase 5. In a case where the Zr—B—R—Cu grain boundary further contains the T-rich phase, the coercivity of the permanent magnet 2 is likely to increase.

Each of the $ZrB_2$ crystal 3, the R—Cu-rich phase 5, the main phase grain 4, and the other grain boundary phases is clearly identified on the basis of difference in a composition. The compositions thereof may be specified through analysis of the cross-section 2*cs* of the permanent magnet 2. The cross-section 2*cs* of the permanent magnet 2 may be analyzed by an electron probe micro analyzer (EPMA) on which an energy dispersive X-ray spectroscopy (EDS) device is equipped. Each of the $ZrB_2$ crystal 3, the R—Cu-rich phase 5, the main phase grain 4, and the other grain boundary phases can be identified on the basis of contrast in an image of the cross-section 2*cs* of the permanent magnet 2 which is captured by a scanning electron microscope (SEM) such as a scanning transmission electron microscope (STEM). An internal structure of the Zr—B—R—Cu grain boundary may be specified, for example, by contrast in an image obtained by a high angle annular dark field-STEM image (HAADF-STEM image) or the like. A crystal structure of the $ZrB_2$ crystal 3 may be specified on the basis of a HAADF-STEM image having lattice resolution and an electron beam diffraction pattern.

According to the EPMA, a distribution map of each of Zr, B, and Cu in the cross-section 2*cs* of the permanent magnet 2 is measured. In a case where an arbitrary one kind of element is noted as Ex, a bright site in an Ex distribution map is a site where a concentration of Ex is higher than an average value of a concentration of Ex in the cross-section 2*cs* of the permanent magnet 2. In other words, the bright site in the Ex distribution map is a site where intensity of a characteristic X-ray of Ex is higher than an average value of the intensity of the characteristic X-ray of Ex in the cross-section 2*cs* of the permanent magnet 2. Sites where a concentration of each element in the distribution map of each of Zr, B, and Cu is high overlap each other at the Zr—B—R—Cu grain boundary. That is, due to the overlapping of the distribution maps of Zr, B, and Cu, a position of the Zr—B—R—Cu grain boundary can be specified. After the position of the Zr—B—R—Cu grain boundary is specified, the concentration of each element in the Zr—B—R—Cu grain boundary can be measured by locally analyzing the Zr—B—R—Cu grain boundary with the EPMA.

An average grain size or a median diameter (D50) of the main phase grain 4 is not particularly limited, but may be, for example, from 1.0 to 10.0 μm, or from 1.5 to 6.0 μm. A total volume ratio of the main phase grains 4 in the permanent magnet 2 is not particularly limited, but may be, for example, 80% by volume or more and less than 100% by volume.

A specific composition of the entirety of the permanent magnet 2 will be described below. However, the composition of the permanent magnet 2 is not limited to the following composition. A content of each element in the permanent magnet 2 may be outside the following range as long as the effect caused by the Zr—B—R—Cu grain boundary is obtained.

A total content of the rare-earth element R in the entirety of the permanent magnet may be from 25 to 35% by mass, or from 28 to 34% by mass. When the content of R is within this range, the residual magnetic flux density and the coercivity tend to increase. In a case where the content of R is excessively small, the main phase grain ($R_2T_{14}B$) is less likely to be formed, and an a-Fe phase having soft magnetism is likely to be formed. As a result, the coercivity tends to decrease. On the other hand, in a case where the content of R is excessively large, a volume ratio of the main phase grains becomes low, and thus the residual magnetic flux density tends to decrease. From the viewpoint that the residual magnetic flux density and the coercivity are likely to increase, a total ratio of Nd and Pr to the entirety of rare-earth element R may be from 80 to 100 atomic %, or from 95 to 100 atomic %.

A content of B in the entirety of the permanent magnet may be from 0.90 to 1.05% by mass. In a case where the content of B is 0.90% by mass or more, the permanent magnet is likely to contain the Zr—B—R—Cu grain boundary. In addition, in a case where the content of B is 0.90% by mass or more, the residual magnetic flux density of the permanent magnet is likely to increase. In a case where the content of B is 1.05% by mass or less, the coercivity of the permanent magnet is likely to increase. In a case where the content of B is within the above-described range, the squareness ratio (Hk/HcJ) of the permanent magnet tends to be near 1.0. M is an intensity of a demagnetizing field corresponding to 90% of the residual magnetic flux density (Br) in the second quadrant of a magnetization curve.

A content of Zr in the entirety of the permanent magnet may be from 0.10 to 1.00% by mass, and may be from 0.25 to 1.00% by mass. In a case where the content of Zr is 0.25% by mass or more, the permanent magnet is likely to contain the Zr—B—R—Cu grain boundary. In addition, in a case where the content of Zr is 0.25% by mass or more, abnormal grain growth of the main phase grain in the sintering step to be described later is likely to be suppressed, and the squareness ratio of the permanent magnet is likely to be near 1.0, and the permanent magnet is likely to be magnetized under a low magnetic field. In a case where the content of Zr is 1.00% by mass or less, the residual magnetic flux density of the permanent magnet is likely to increase.

A content of Cu in the entirety of the permanent magnet may be from 0.04 to 0.50% by mass. In a case where the content of Cu is 0.04% by mass or more, the permanent magnet is likely to contain the Zr—B—R—Cu grain boundary. In addition, in a case where the content of Cu is 0.04% by mass or more, the coercivity of the permanent magnet is likely to increase, and the corrosion resistance of the permanent magnet is likely to be improved. In a case where the content of Cu is 0.50% by mass or less, the coercivity and the residual magnetic flux density of the permanent magnet are likely to increase.

A content of Ga in the entirety of the permanent magnet may be from 0.03 to 0.30% by mass. In a case where the content of Ga is 0.03% by mass or more, the permanent magnet is likely to contain the T-rich phase, and the coercivity of the permanent magnet is likely to increase. In a case where the content of Ga is 0.30% by mass or less, generation of a subphase (for example, a phase including R, T, and Ga) is appropriately suppressed, and thus the residual magnetic flux density of the permanent magnet is likely to increase.

A content of O in the entirety of the permanent magnet may be from 0.03 to 0.4% by mass, or from 0.05 to 0.2% by mass. In a case where the content of O is excessively small, the R—O—C phase is less likely to be formed. In a case where the content of O is excessively large, the coercivity of the permanent magnet is likely to decrease.

A content of C in the entirety of the permanent magnet may be from 0.03 to 0.3% by mass, or from 0.05 to 0.15% by mass. In a case where the content of C is excessively small, the R—O—C phase is less likely to be formed. In a case where the content of C is excessively large, the coercivity of the permanent magnet is likely to decrease.

A content of Co in the entirety of the permanent magnet may be from 0.30 to 3.00% by mass. In a case where the content of Co is 0.30% by mass or more, the corrosion resistance of the permanent magnet is likely to be improved. In a case where the content of Co is more than 3.00% by mass, an effect of improving the corrosion resistance of the permanent magnet plateaus, and there is no appropriate advantage against the cost of Co.

A content of aluminum (Al) in the entirety of the permanent magnet may be from 0.05 to 0.50% by mass. In a case where the content of Al is 0.05% by mass or more, the coercivity of the permanent magnet is likely to increase. In addition, the content of Al is 0.05% by mass or more, there is a tendency that a variation amount of magnetic characteristics (particularly, the coercivity) of the permanent magnet in accordance with a temperature variation in an aging treatment or a heat treatment to be described later is small, and thus there is a tendency that a deviation in the magnetic characteristics of the permanent magnet that is mass-produced is suppressed. In a case where the content of Al is 0.50% by mass or less, the residual magnetic flux density of the permanent magnet is likely to increase. In addition, in a case where the content of Al is 0.50% by mass or less, the variation of the coercivity in accordance with the temperature variation is likely to be suppressed.

A content of manganese (Mn) in the entirety of the permanent magnet may be from 0.02 to 0.10% by mass. In a case where the content of Mn is 0.02% by mass or more, the residual magnetic flux density and the coercivity of the permanent magnet are likely to increase. In a case where the content of Mn is 0.10% by mass or less, the coercivity of the permanent magnet is likely to increase.

A total content of Tb and Dy in the entirety of the permanent magnet may be from 0.00 to 5.00% by mass, or from 0.20 to 5.00% by mass. In some cases, the total content of Tb and Dy in the entirety of the permanent magnet is noted as $C_{Tb+Dy}$. When $C_{Tb+Dy}$ of the permanent magnet is 0.20% by mass or more, the magnetic characteristics (particularly, the coercivity) of the permanent magnet are likely to increase. In addition, in a case where $C_{Tb+Dy}$ of the permanent magnet is within the above-described range, the permanent magnet according to this embodiment is likely to have more excellent magnetic characteristics in comparison to a permanent magnet in the related art with the same $C_{Tb+Dy}$. In other words, even in a case where $C_{Tb+Dy}$ of the permanent magnet according to this embodiment is equal to or less than $C_{Tb+Dy}$ of the permanent magnet in the related art, the permanent magnet according to this embodiment can have more excellent magnetic characteristics in comparison to the permanent magnet in the related art. That is, the permanent magnet according to this embodiment makes it possible to further reduce $C_{Tb+Dy}$ in comparison to $C_{Tb+Dy}$ of the permanent magnet in the related art without deteriorating the magnetic characteristics.

The balance excluding the above-described element from the permanent magnet may be only Fe, or Fe and other elements. In order for the permanent magnet to have sufficient magnetic characteristics, in the balance, a total content of elements other than Fe may be 5% by mass or less with respect to the total mass of the permanent magnet.

The permanent magnet may include at least one kind selected from the group consisting of silicon (Si), titanium (Ti), vanadium (V), chromium (Cr), nickel (Ni), niobium (Nb), molybdenum (Mo), hafnium (Hf), tantalum (Ta), tungsten (W), bismuth (Bi), tin (Sn), calcium (Ca), nitrogen (N), chlorine (Cl), sulfur (S), and fluorine (F) as the other elements.

The composition of the entirety of the permanent magnet may be analyzed, for example, by a fluorescent X-ray (XRF) analysis method, a high-frequency inductively coupled plasma (ICP) emission analysis method, an inert gas melting—non dispersive infrared absorption (NDIR) method, a combustion in oxygen stream—infrared absorption method, an inert gas melting—heat conductivity method, or the like.

The permanent magnet according to this embodiment may be applied to a motor, a generator, an actuator, or the like. For example, the permanent magnet is used in various fields such as a hybrid vehicle, an electric vehicle, a hard disk drive, a magnetic resonance imaging apparatus (MRI), a smartphone, a digital camera, a flat-screen TV, a scanner, an air conditioner, a heat pump, a refrigerator, a vacuum cleaner, a washing and drying machine, an elevator, and a wind power generator.

(Outline of Method for Manufacturing Permanent Magnet)

A method for manufacturing a permanent magnet according to this embodiment includes a diffusing step of causing a diffusing material to adhere to a surface of a magnet base material, and heating the magnet base material to which the diffusing material adheres. The magnet base material includes R, T, B, and Zr. At least a part of R included in the magnet base material is Nd. At least a part of T included in the magnet base material is Fe. The diffusing material includes a first component, a second component, and a third component. The first component is at least one kind of a Nd hydride and a Pr hydride. The second component is at least one kind selected from the group consisting of a Cu simple substance, a Cu-including alloy, and a Cu compound. The third component is at least one kind of a Tb hydride and a Dy hydride.

When using the diffusing material including both the first component and the second component, the R—Cu-rich liquid phase is formed in the grain boundary multiple junction in the diffusing step, and thus the permanent magnet can contain the Zr—B—R—Cu grain boundary. That is, the majority of Cu included in the Zr—B—R—Cu grain boundary is derived from the second component included in the diffusing material. In a case where the diffusing material does not include at least one of the first component and the second component, due to deficiency of Cu or insufficient diffusion of Cu, the R—Cu-rich liquid phase is less likely to be formed in the grain boundary multiple junction in the diffusing step, and thus it is difficult for the permanent magnet to contain a Zr—B—R—Cu grain boundary.

(Details of Respective Steps)

Hereinafter, details of respective steps in the method for manufacturing the permanent magnet will be described.

[Step of Preparing Raw Material Alloy]

In a step of preparing a raw material alloy, the raw material alloy is produced from metals (raw material metals) including respective elements which constitute the permanent magnet by a strip casting method or the like. For example, the raw material metals may be a simple substance (metal simple substance) of a rare-earth element, an alloy including the rare-earth element, pure iron, ferroboron, or an alloy including these. The raw material metals are weighed to match a composition of a desired magnet base material. A content of each element (excluding Nd, Pr, Cu, Tb, and Dy) in the permanent magnet may be controlled on the basis of a content of each element in the magnet base material (raw material alloy). A content of each of Nd, Pr, Cu, Tb, and Dy in the permanent magnet may be controlled on the basis of a content of each of Nd, Pr, Cu, Tb, and Dy in the magnet base material (raw material alloy), and a composition and an amount of the diffusing material that is used in the diffusing step. As the raw material alloy, two or more kinds of alloys different in a composition may be used.

The raw material alloy includes at least R, T, B, and Zr. The raw material alloy may further include Cu. The raw material alloy may not include Cu.

At least a part of R included in the raw material alloy is Nd. The raw material alloy may further include at least one kind selected from the group consisting of Sc, Y, La, Ce, Pr, Pin, Sin, Eu, Gd, Tb, Dy, Ho, Er, Tm, Yb, and Lu as another R. The raw material alloy may include Pr. The raw material alloy may not include Pr. The raw material alloy may include one or both of Tb and Dy. The raw material alloy may not include one or both of Tb and Dy.

At least a part of T included in the raw material alloy is Fe. All T included in the raw material alloy may be Fe. T included in the raw material alloy may be Fe and Co. The raw material alloy may further include another transition metal element other than Fe and Co. T described below represents only Fe, or Fe and Co.

The raw material alloy may further include another element in addition to R, T, B, and Zr. For example, the raw material alloy may include at least one kind selected from the group consisting of Ga, Al, Mn, C, O, N, Si, Ti, V, Cr, Ni, Nb, Mo, Hf, Ta, W, Bi, Sn, Ca, Cl, S, and F as the other element.

[Pulverization Step]

In a pulverization step, an alloy powder is prepared by pulverizing the raw material alloy in a non-oxidizing atmosphere. The raw material alloy may be pulverized in two steps of a coarse pulverization step and a fine pulverization step. In the coarse pulverization step, for example, a pulverization method such as a stamp mill, a jaw crusher, and a brown mill may be used. The coarse pulverization step may be performed in an inert gas atmosphere. After storing hydrogen in the raw material alloy, the raw material alloy may be pulverized. That is, hydrogen storage pulverization may be performed as the coarse pulverization step. In the coarse pulverization step, the raw material alloy may be pulverized until a particle size becomes approximately several hundred μm. In the fine pulverization step subsequent to the coarse pulverization step, the raw material alloy that has undergone the coarse pulverization step may be further pulverized until an average particle size becomes several μm. In the fine pulverization step, for example, a jet mill may be used. The raw material alloy may be pulverized by a one-step pulverization step. For example, only the fine pulverization step may be performed. In a case where a plurality of kinds of raw material alloys are used, after respective raw material alloys are pulverized, the respective raw material alloys may be mixed. An alloy powder may include at least one kind of lubricant (pulverization aid) selected from the group consisting of a fatty acid, fatty acid ester, fatty acid amide, and a metal salt of fatty acid (metal soap). In other words, the raw material alloy may be pulverized in combination with the pulverization aid.

[Pressing Step]

In a pressing step, the alloy powder is pressed in a magnetic field to obtain a green compact containing an alloy powder oriented in accordance with the magnetic field. For example, the green compact may be obtained by pressing the alloy powder in a mold while applying a magnetic field to the alloy powder in the mold. A pressure applied to the alloy powder by the mold may be from 20 to 300 MPa. The intensity of the magnetic field applied to the alloy powder may be from 950 to 1600 kA/m. A shape of the green compact may be the similar as that of the permanent magnet.

[Sintering Step]

In a sintering step, the green compact is sintered in vacuum or an inert gas atmosphere to obtain a sintered body. Sintering conditions may be appropriately set in correspondence with a composition of a target permanent magnet, a pulverization method and a particle size of the raw material alloy, and the like. For example, a sintering temperature may be from 1000 to 1200° C. A sintering time may be from 1 to 20 hours.

[Aging Treatment Step]

After the sintering step, an aging treatment step may be performed. However, the aging treatment step is not essential. In the aging treatment step, the sintered body may be heated at a temperature lower than the sintering temperature. In the aging treatment step, the sintered body may be heated in vacuum or an inert gas atmosphere. A diffusing step to be described later may also serve as the aging treatment step. In this case, the aging treatment step different from the diffusing step may not be performed. The aging treatment step may be composed of a first aging treatment and a second aging treatment subsequent to the first aging treatment. In the first aging treatment, the sintered body may be heated at a temperature of from 700 to 900° C. A duration time of the first aging treatment may be from 1 to 10 hours. In the second aging treatment, the sintered body may be heated at a temperature of from 500 to 700° C. A duration time of the second aging treatment may be from 1 to 10 hours.

Through the above-described steps, the sintered body is obtained. The sintered body is a magnet base material that is used in the following diffusing step. The magnet base material (sintered body) contains a plurality of main phase grains (alloy grains) sintered each other. However, a composition of each main phase grain contained in the magnet base material is different from a composition of each main phase grain contained in the permanent magnet that has undergone the following diffusing step. The main phase grain includes at least Nd, Fe, B, and Zr. The main phase grain may contain an $R_2T_{14}B$ crystal. The magnet base material contains a plurality of the grain boundary multiple junctions. However, a composition of each grain boundary multiple junction contained in the magnet base material is different from a composition of each grain boundary multiple junction contained in the completed permanent magnet. The magnet base material also contains a plurality of the two-grain boundaries as a grain boundary. However, a composition of each two-grain boundary contained in the magnet base material is different from an average composition of each two-grain boundary contained in the permanent magnet that has undergone the following diffusing step. A concentration of Nd in the grain boundary multiple junction may be higher than a concentration of Nd in the main phase grain. That is, the grain boundary multiple junction in the magnet base material may contain the R-rich phase already. In addition, as described above, $ZrB_2$ derived from Zr and B in the main phase grains may be generated in the grain boundary multiple junction.

[Diffusing Step]

In the diffusing step, a diffusing material is caused to adhere to a surface of the magnet base material, and the magnet base material to which the diffusing material adheres is heated. The diffusing material includes at least the first component, the second component, and the third component. The diffusing material may further include another component other than the first component, the second component, and the third component. One or both of Nd and Pr are noted as RL for convenience of explanation. One or both of Tb and Dy are noted as RH.

The first component is at least one kind of a Nd hydride and a Pr hydride. The Nd hydride may be at least any one, for example, of $NdH_2$ and $NdH_3$. The Pr hydride may be at least any one, for example, of $PrH_2$ and $PrH_3$. The Nd hydride and the Pr hydride may be a hydride of an alloy consisting of Nd and Pr.

The second component is at least one kind selected from the group consisting of a Cu simple substance, a Cu-including alloy, and a Cu compound. The second component may not include Nd, Pr, Tb, and Dy. The Cu-including alloy may include at least one kind of element excluding Nd, Pr, Tb, and Dy among elements included in the permanent magnet. For example, the copper compound is at least one kind selected from the group consisting of a hydride and an oxide. For example, a Cu hydride may be CuH. For example, a Cu oxide may be at least any one of $Cu_2O$ and CuO.

The third component is at least one kind of a Tb hydride and a Dy hydride. For example, the Tb hydride may be at least any one of $TbH_2$ and $TbH_3$. For example, the Tb hydride may be a hydride of an alloy consisting of Tb and Fe. For example, the Dy hydride may be at least any one of $DyH_2$ and $DyH_3$. For example, the Dy hydride may be a hydride of an alloy consisting of Dy and Fe. For example, the Tb hydride and the Dy hydride may be a hydride of an alloy consisting of Tb, Dy, and Fe.

Each of the first component, the second component, and the third component may be a powder. When each of the first component, the second component, and the third component is a powder, RL in the first component, Cu in the second component, and RH in the third component are likely to diffuse into the magnet base material. Each of the first component, the second component, and the third component may be produced by a coarse pulverization step and a fine pulverization step. A method of each of the coarse pulverization step and the fine pulverization step may be the same as in the pulverization step of the raw material alloy. The first component, the second component, and the third component may be collectively and simultaneously pulverized. A particle size of each of the first component, the second component, and the third component may be freely controlled by the coarse pulverization step and the fine pulverization step. For example, after storing hydrogen in a metal simple substance, the metal hydride may be dehydrogenated. As a result, a coarse powder consisting of a metal hydride is obtained. When the coarse hydride powder is further pulverized by a jet mill, a fine powder consisting of the metal hydride is obtained. The fine powder may be used as the first component, the second component, and the third component. A powder of the second component may be produced by a method different from a method in the first component and the third component. For example, after the powder of the second component is produced by a method such as an electrolytic method or an atomization method, the powder of the second component may be mixed with the first component and the third component.

When the magnet base material to which the diffusing material adheres is heated, RL derived from the first component diffuses into the magnet base material, Cu derived from the second component diffuses into the magnet base material, and RH derived from the third component diffuses into the magnet base material. The present inventors assume that RL, Cu, and RH diffuse into the magnet base material from the surface of the magnet base material due to the following mechanism. However, a diffusion mechanism is not limited to the following mechanism.

In the sintering step, a grain boundary phase (R phase) in which a concentration of RL is high is formed in the grain boundary multiple junction 6 and the two-grain boundary 10. RL in the R phase is derived from the alloy powder. The R phase existing in the grain boundary multiple junction 6 and the two-grain boundary 10 becomes a liquid phase (R liquid phase) in accordance with temperature rising in the diffusing step. In addition, when the diffusing material is dissolved in the R liquid phase, components of the diffusing material diffuse into the magnet base material from the surface of the magnet base material. In a case where only the third component (an RH hydride) is used as the diffusing material, a dehydrogenation reaction of the RH hydride adhered to the surface of the magnet base material occurs in accordance with temperature rising in the diffusing step. RH generated by the dehydrogenation reaction is likely to be rapidly dissolved in the R liquid phase bleeding out from the inside of the magnet base material to the surface. As a result, a concentration of RH near the surface of the magnet base material rapidly increases, and thus diffusion of RH into the main phase grains located near the surface of the magnet base material is likely to occur. That is, RH is likely to stay inside the main phase grains located near the surface of the magnet base material, and is less likely to diffuse into the magnet base material. Accordingly, an amount of RH diffusing into the magnet is reduced, and an amount of increase in the coercivity of the permanent magnet decreases.

On the other hand, in a case where the diffusing material includes the first component (RL), the second component (Cu), and the third component (RH), since an eutectic temperature of Cu and RL is low, when the R liquid phase in the magnet base material bleeds out to the surface of the magnet base material, Cu included in the diffusing material is likely to be dissolved in the R liquid phase before RH. That is, dissolution of Cu in the R liquid phase occurs first, and then the concentration of Cu in the R liquid phase located near the surface of the magnet base material rises. As a result, the R—Cu-rich liquid phase is generated near the surface of the magnet base material, and Cu further diffuses to the R liquid phase inside the magnet base material. On the other hand, the first component RL and the third component RH begin to be dissolved in the R—Cu-rich liquid phase after occurrence of the dehydrogenation reaction of the hydride. A eutectic temperature of the first component RL and Cu is approximately 500° C., and a eutectic temperature of the third component RH and Cu is approximately from 700 to 800° C. Accordingly, after the first component RL is dissolved in the R—Cu-rich liquid phase near the surface of the magnet base material in succession to Cu, the third component RH is dissolved in the R—Cu-rich liquid phase. When the first component RL is dissolved in the liquid phase in subsequent to Cu, diffusion of Cu into the magnet base material through the liquid phase is promoted, and thus the R—Cu-rich liquid phase is further generated in a grain boundary of the magnet base material.

The third component among the first component (RL), the second component (Cu), and the third component (RH) is likely to be finally dissolved in the liquid phase, and thus RH derived from the third component diffuses into the liquid phase inside the magnet base material in subsequent to Cu and RL. As a result, in comparison to a case where the first component and the second component are absent, a rapid increase of a concentration of RH near the surface of the magnet base material is suppressed. Since the rapid increase in the concentration of RH near the surface of the magnet base material is suppressed, and thus excessive diffusion of RH into the main phase grain located near the surface of the magnet base material is suppressed. As a result, a sufficient amount of RH can diffuse into the magnet base material, and thus the coercivity of the permanent magnet is improved.

$ZrB_2$ formed in the grain boundary multiple junction in the sintering step is easily dissolved in the R—Cu-rich liquid phase. A $ZrB_2$ crystal re-deposits in the R—Cu-rich liquid phase due to cooling (rapid cooling) after the diffusing step, and the R—Cu-rich liquid phase solidifies to become an R—Cu-rich phase.

In the diffusing step, the surface layer part ($R_2Fe_{14}B$) of the main phase grain is dissolved in the R—Cu-rich liquid phase generated in a grain boundary. In a process in which the surface layer part re-deposits from the R—Cu-rich liquid phase due to cooling (rapid cooling) after the diffusing step, the surface layer part receives the third component (RH) in the R—Cu-rich liquid phase, and thus the surface layer part including RH is formed. As described above, since $ZrB_2$ is dissolved in the R—Cu-rich liquid phase in the diffusing step, a concentration of B in the grain boundary (R—Cu-rich liquid phase) increases. The increase in the concentration of B in the R—Cu-rich liquid phase suppresses dissolution of the surface layer part ($R_2Fe_{14}B$) in the R—Cu-rich liquid phase. Due to suppression of the dissolution of the surface layer part ($R_2Fe_{14}B$), the thickness of the surface layer part re-depositing while receiving RH decreases. Since RH concentrates in the thin surface layer part, a concentration of RH in the surface layer part increases. As a result, an anisotropic magnetic field locally increases in the vicinity of the two-grain boundary, and a magnetization reversal nucleus is less likely to occur in the vicinity of the two-grain boundary. Thus, the coercivity of the permanent magnet increases.

As described above, according to this embodiment, the coercivity of the permanent magnet can be increased.

From the viewpoint that the magnetic characteristics of the permanent magnet are likely to be improved due to the above-described diffusion mechanism, the first component may be at least one kind of a neodymium hydride and a praseodymium hydride, the second component may be a copper simple substance, and the third component may be at least one kind of a Tb hydride and a Dy hydride.

In the diffusing step, a slurry including the first component, the second component, the third component, and a solvent may adhere to the surface of the magnet base material as a diffusing material. The solvent included in the slurry may be a solvent other than water. For example, the solvent may be an organic solvent such as alcohol, aldehyde, and ketone. The diffusing material may further include a binder so that the diffusing material easily adheres to the surface of the magnet base material. The slurry may include the first component, the second component, the third component, the solvent, and the binder. A paste having viscosity higher than that of slurry may be formed by mixing the first component, the second component, the third component, the binder, and the solvent. The paste may adhere to the surface of the magnet base material. The paste is a mixture having fluidity and high viscosity. Before the diffusing step, the solvent included in the slurry or paste may be removed by heating the magnet base material to which the slurry or the paste adheres.

The diffusing material may adhere to a part or the entirety of the surface of the magnet base material. A diffusing material adhesion method is not limited. For example, the slurry or the paste may be applied to the surface of the magnet base material. The diffusing material itself or the slurry may be sprayed to the surface of the magnet base material. The diffusing material may be deposited on the surface of the magnet base material. The magnet base material may be immersed in the slurry. The diffusing material may adhere to the magnet base material through an adhesive (binder) covering the surface of the magnet base material. A part or the entirety of the surface of the magnet base material may be covered with a sheet including the diffusing material.

A temperature (diffusion temperature) of the magnet base material in the diffusing step may be the eutectic temperature of RL and Cu or higher, and may be lower than the above-described sintering temperature. For example, the diffusion temperature may be from 800 to 950° C. In the diffusing step, the temperature of the magnet base material may be gradually raised from a temperature lower than the diffusion temperature to the diffusion temperature. For example, time (diffusion time) for which the temperature of the magnet base material is maintained at the diffusion temperature may be from 1 to 50 hours. An atmosphere around the magnet base material in the diffusing step may be a non-oxidizing atmosphere. For example, the non-oxidizing atmosphere may be a rare gas such as argon. In addition, a pressure of the atmosphere around the magnet base material in the diffusing step may be 1 kPa or less. When the diffusing step is performed in the pressure-reduced atmosphere, the dehydrogenation reaction of the hydride (the first component and the third component) is promoted, and dissolution of the diffusing material in the liquid phase is likely to proceed.

A total mass of Tb, Dy, Nd, Pr, and Cu in the diffusing material may be noted as $M_{ELEMENTS}$. A total mass of Tb and Dy in the diffusing material may be from 47 to 86% by mass, from 55 to 85% by mass, from 55 to 80% by mass, or from 59 to 75% by mass with respect to $M_{ELEMENTS}$. The total mass of Tb and Dy may be referred to as the total mass of RH in the diffusing material. In a case where the total mass of RH is 55% by mass or more, a total amount of the diffusing material necessary for an increase in the coercivity of the permanent magnet is likely to decrease. In a case where the total mass of RH is 85% by mass or less, an amount of RH staying inside the main phase grain located near the surface of the magnet base material decreases, and the coercivity of the permanent magnet is likely to be improved.

A total mass of Nd and Pr in the diffusing material may be from 10 to 43% by mass, from 10 to 37% by mass, from 15 to 37% by mass, or from 15 to 32% by mass with respect to the $M_{ELEMENTS}$. The total mass of Nd and Pr may be referred to as the total mass of RL in the diffusing material. In a case where the total mass of RL is 10% by mass or more, the R—Cu-rich liquid phase is likely to exist up to the inside of the magnet base material in the diffusing step, and a concentration of RH in the surface layer part of the main phase grain is likely to be high. In a case where the total mass of RL is 37% by mass or less, the third component (RH) is not excessively diluted by the first component (RL), and the coercivity of the permanent magnet is likely to increase.

A content of Cu in the diffusing material may be from 4 to 30% by mass, from 8 to 25% by mass, or from 8 to 20% by mass with respect to the $M_{ELEMENTS}$. In a case where the content of Cu is 4% by mass or more, the R—Cu-rich liquid phase is likely to be generated, and a concentration of RH in the surface layer part of the main phase grain is likely to be high. In a case where the content of Cu is 30% by mass or less, a decrease in the coercivity and the residual magnetic flux density of the permanent magnet is likely to be suppressed. In a case where the magnet base material includes Cu, Cu derived from the magnet base material may exhibit the same effect as in Cu derived from the diffusing material. However, it is difficult to obtain the same effect as in Cu derived from the diffusing material with only Cu derived from the magnet base material.

A particle size of each of the first component, the second component, and the third component may be within a range of from 0.3 to 32 μm, or from 0.3 to 90 μm. The particle size of each of the first component, the second component, and the third component may be referred to as a particle size of the diffusing material. In accordance with an increase in the particle size of the diffusing material, oxygen included in the diffusing material is reduced, and thus diffusion of RH, RL, and Cu is less likely to be blocked by oxygen. As a result, the coercivity of the permanent magnet is likely to increase. In accordance with a decrease in the particle size of the diffusing material, time necessary for dissolution of each of the first component, the second component, and the third component is short, and each of RH, RL, and Cu is likely to diffuse into the magnet base material. As a result, the coercivity of the permanent magnet is likely to increase. In addition, in accordance with the decrease in the particle size of the diffusing material, the diffusing material is likely to adhere to the surface of the magnet base material without unevenness, and each of RH, RL, and Cu is likely to diffuse into the magnet base material without unevenness. As a result, a deviation in the coercivity of the permanent magnet is suppressed, and the squareness ratio is likely to be near 1.0. The particle sizes of the first component, the second component, and the third component may be the same as each other. The particle sizes of the first component, the second component, and the third component may be different from each other.

A mass of the magnet base material may be expressed by 100 parts by mass, and a total mass of Tb and Dy in the diffusing material may be from 0.0 to 2.0 parts by mass with respect to 100 parts by mass of magnet base material. In a case where the total mass of Tb and Dy with respect to the magnet base material is within the above-described range, a total content of Tb and Dy in the entirety of the permanent magnet is likely to be controlled to from 0.20 to 2.00% by mass, and the magnetic characteristics of the permanent magnet are likely to be improved.

A total content of Nd and Pr in the magnet base material may be from 23.0 to 32.0% by mass. A total content of Tb and Dy in the magnet base material may be from 0.0 to 5.0% by mass. A total content of Fe and Co in the magnet base material may be from 63 to 72% by mass. A content of Cu in the magnet base material may be from 0.04 to 0.5% by mass. In a case where the magnet base material has the above-described composition, the magnetic characteristics of the permanent magnet are likely to be improved.

[Heat Treatment Step]

The magnet base material that has undergone the diffusing step may be used as a finished product of the permanent magnet. Alternatively, after the diffusing step, a heat treatment step may be performed. In the heat treatment step, the magnet base material may be heated at from 450 to 600° C. In the heat treatment step, the magnet base material may be heated at the temperature for from 1 to 10 hours. Due to the heat treatment step, the magnetic characteristics (particularly, the coercivity) of the permanent magnet are likely to be improved.

Dimensions and a shape of the magnet base material which has undergone the diffusing step or the heat treatment step may be adjusted by a processing method such as cutting and polishing.

The permanent magnet is completed by the above-described method.

The invention is not limited to the above-described embodiment. For example, the magnet base material used in the diffusing step may be a hot deformed magnet instead of the sintered body.

EXAMPLES

An aspect of the invention will be described in more detail with reference to the following examples and comparative examples. The invention is not limited to the following examples.

Example 1

<Production of Magnet Base Material>

A raw material alloy was produced from raw material metals by a strip casting method. A composition of the raw material alloy was adjusted by weighing of the raw material metals so that the composition of the raw material alloy after sintering matches a composition of the magnet base material in the following Table 1.

After hydrogen was stored in the raw material alloy at room temperature, the raw material alloy was heated at 600° C. for one hour in an Ar atmosphere for dehydrogenation, thereby obtaining a raw material alloy powder. That is, a hydrogen pulverization treatment was performed.

Oleic acid amide was added to the raw material alloy powder as a pulverization aid, and these were mixed by a conical mixer. A content of oleic acid amide in the raw material alloy powder was adjusted to 0.1% by mass. In the subsequent fine pulverization step, an average particle size of the raw material alloy powder was adjusted to 3.5 μm by using a jet mill. In the subsequent pressing step, the raw material alloy powder was filled in a mold. The raw material powder was pressed at 120 MPa while applying a magnet field of 1200 kA/m to the raw material powder in the mold, thereby obtaining a green compact.

In a sintering step, the green compact was heated at 1060° C. for four hours in vacuum, and was rapidly cooled down, thereby obtaining a sintered body.

The magnet base material was obtained by the above-described method. A content of each element in the magnet base material is shown in the following Table 1.

<Production of Diffusing Material A>

As a raw material of a diffusing material A, a Tb simple substance (metal simple substance) was used. The purity of the Tb simple substance was 99.9% by mass.

A hydrogen gas flow was supplied to the Tb simple substance to store hydrogen in the Tb simple substance. After storage of hydrogen, the Tb simple substance was heated at 600° C. for one hour in an Ar atmosphere for dehydrogenation, thereby obtaining a powder consisting of a Tb hydride. That is, a hydrogen pulverization treatment was performed.

Zinc stearate was added to the powder of the Tb hydride as the pulverization aid, and these were mixed by a conical mixer. A content of zinc stearate in the Tb hydride powder was adjusted to 0.05% by mass. In the subsequent fine pulverization step, the Tb hydride powder was further pulverized in a non-oxidizing atmosphere in which the content of oxygen is 3000 ppm. In the fine pulverization step, a jet mill was used. An average particle size of the powder consisting of the Tb hydride was adjusted to approximately 10.0 μm.

A fine powder (third component) consisting of the Tb hydride ($TbH_2$) was obtained by the above-described method.

A fine powder (first component) consisting of a Nd hydride ($NdH_2$) was produced from a Nd simple substance. The purity of the Nd simple substance was 99.9% by mass. An average particle size of the fine powder consisting of the Nd hydride was approximately 10.0 μm. The method for producing the first component was the same as the method for producing the third component except that the Nd simple substance was used as a raw material.

The fine powder (first component) consisting of the Nd hydride, a fine powder (second component) consisting of a Cu simple substance, the fine powder (third component) consisting of the Tb hydride, an alcohol (solvent), and an acrylic resin (binder) were kneaded to produce the paste-like diffusing material A. A mass ratio of the first component in the diffusing material A was 17.0 parts by mass. A mass ratio of the second component in the diffusing material A was 11.2 parts by mass. A mass ratio of the third component in the diffusing material A was 46.8 parts by mass. A mass ratio of the solvent in the diffusing material A was 23.0 parts by mass. A mass ratio of the binder in the diffusing material A was 2.0 parts by mass.

<Production of Permanent Magnet>

Dimensions of the magnet base material was adjusted to 14 mm (vertical)×10 mm (horizontal)×3.7 mm (thickness) by mechanical processing on the magnet base material. After adjusting the dimensions of the magnet base material, an etching treatment on the magnet base material was performed. In the etching treatment, all surfaces of the magnet base material were washed with nitric acid aqueous solution. Next, the all surfaces of the magnet base material were washed with pure water. The magnet base material after washing was dried. A concentration of the nitric acid aqueous solution was 0.3% by mass. After the etching treatment, the following diffusing step was performed.

In the diffusing step, the diffusing material A was applied to the all surfaces of the magnet base material. A mass of the diffusing material A applied to the magnet base material was adjusted so that a mass of Tb included in the diffusing material A is set to 0.8 parts by mass with respect to 100 parts by mass of magnet base material. The magnet base material applied with the diffusing material A was placed in an oven, and the magnet base material was heated at 160° C. to remove the solvent in the diffusing material A. After removing the solvent, the magnet base material applied with the diffusing material A was heated at 900° C. for 12 hours in an Ar gas.

In a heat treatment step subsequent to the diffusing step, the magnet base material was heated at 540° C. for two hours in an Ar gas.

A permanent magnet of Example 1 was produced by the above-described method. A content of each element in the permanent magnet of Example 1 is shown in the following Table 1.

<Measurement of Magnetic Characteristics of Permanent Magnet>

A surface of the permanent magnet was ground to remove a portion up to a depth of 0.1 mm or less from the surface. Next, the residual magnetic flux density Br and the coercivity HcJ of the permanent magnet were measured by a BH tracer. Br (unit: mT) was measured at room temperature. HcJ (unit: kA/m) was measured at 160° C. Br and HcJ in Example 1 are shown in the following Table 1.

<Analysis of Cross-Section of Permanent Magnet>

After cutting out the permanent magnet to expose a cross-section of the permanent magnet, the permanent magnet was embedded in a hot mounting resin. As the hot mounting resin, Polyfast (product name) manufactured by Struers ApS was used. Polyfast is black bakelite (phenol resin) containing carbon fillers. The cross-section of the permanent magnet embedded in the hot mounting resin was polished by ethanol-based wet polishing. After polishing the cross-section of the permanent magnet, distribution maps of respective elements on the cross-section of the permanent magnet were measured by EPMA. As the EPMA, JXA8500F (product name) manufactured by JEOL Ltd. was used. Dimensions of the distribution maps were 50 μm (vertical)×50 μm (horizontal).

The distribution maps of the respective elements showed that the permanent magnet contains a plurality of main phase grains including Nd, Fe, Co, and B, and a plurality of grain boundary multiple junctions. In the distribution map of each of Zr, B, and Cu, a site (high-concentration site) where an intensity of characteristic X-ray of each element is higher than an average value of an intensity of the characteristic X-ray of each element in each distribution map was specified. The high-concentration sites of each of Zr, B, and Cu overlap each other at the plurality of grain boundary multiple junctions. One grain boundary multiple junction where the high-concentration sites of each of Zr, B, and Cu overlap each other is noted as "Zr—B—Cu grain boundary".

A composition of each of five Zr—B—Cu grain boundaries randomly selected from the cross-section of the permanent magnet was analyzed by EPMA. The composition of the Zr—B—Cu grain boundary was analyzed under the following conditions. Analysis results are shown in the following Table 2. A composition of each of a grain boundary phase 4-1, a grain boundary phase 4-2, a grain boundary phase 4-3, a grain boundary phase 4-4, and a grain boundary phase 4-5 in the following Table 2 corresponds to one Zr—B—Cu grain boundary.

Acceleration voltage: 10 kV

Irradiation current: 0.1 μA

Measurement time (peak/background): 40 sec/10 sec

A composition of the main phase grain was analyzed by the same method as in the Zr—B—Cu grain boundary. An analysis result is shown in the following Table 2. Three grain boundary multiple junctions other than the Zr—B—Cu grain boundary were randomly selected from the cross-section of the permanent magnet. A composition of each of the three grain boundary multiple junctions other than the Zr—B—Cu grain boundary was analyzed by the same method as in the Zr—B—Cu grain boundary. Analysis results are shown in the following Table 2. A composition of each of a grain boundary phase 1, a grain boundary phase 2, and a grain boundary phase 3 in the following Table 2 corresponds to one grain boundary multiple junction other than the Zr—B—Cu grain boundary. The grain boundary phase 1 was the R-rich phase. The grain boundary phase 2 was the R—O—C phase. The grain boundary phase 3 was the T-rich phase.

Figure 4A:
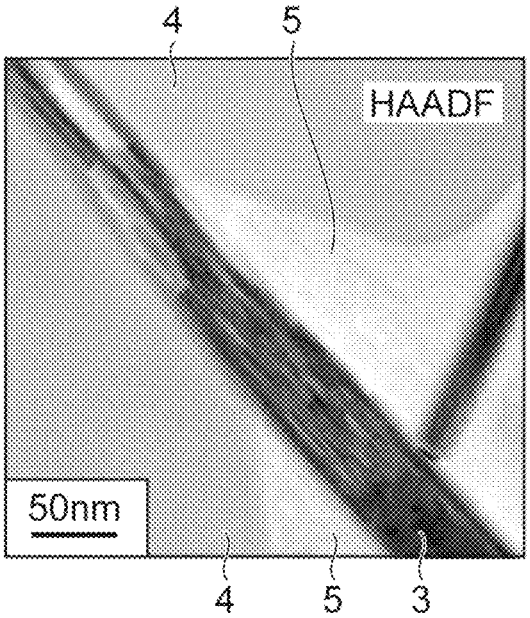
FIG. 4A is an image of a grain boundary multiple junction where both a $ZrB_2$ crystal and an R—Cu-rich phase are contained.

A sample containing the grain boundary phase 4-1 (Zr—B—Cu grain boundary) was produced by slicing the permanent magnet after plane sampling of the permanent magnet using a focused ion beam (FIB). A HAADF-STEM image of the Zr—B—Cu grain boundary containing the grain boundary phase 4-1 was captured. The HAADF-STEM image of the Zr—B—Cu grain boundary containing the grain boundary phase 4-1 is shown in FIG. 4A. As the STEM, Titan-G2 (product name) manufactured by FEI Company was used. Distribution maps of respective elements in a region shown in FIG. 4A were measured by STEM-EDS.

Figure 4B:
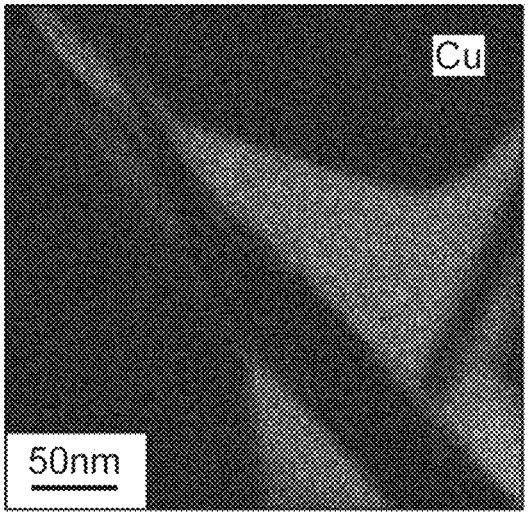
FIG. 4B is a Cu distribution map in a region shown in FIG. 4A.

A Cu distribution map in the region in FIG. 4A is shown in FIG. 4B.

Figure 4C:
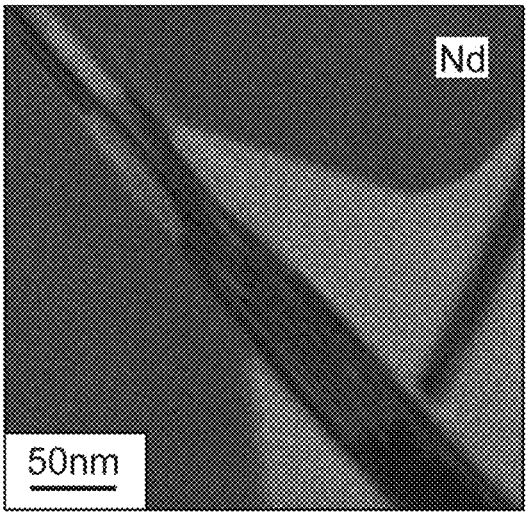
FIG. 4C is a Nd distribution map in the region shown in FIG. 4A.

A Nd distribution map in the region in FIG. 4A is shown in FIG. 4C.

Figure 4D:
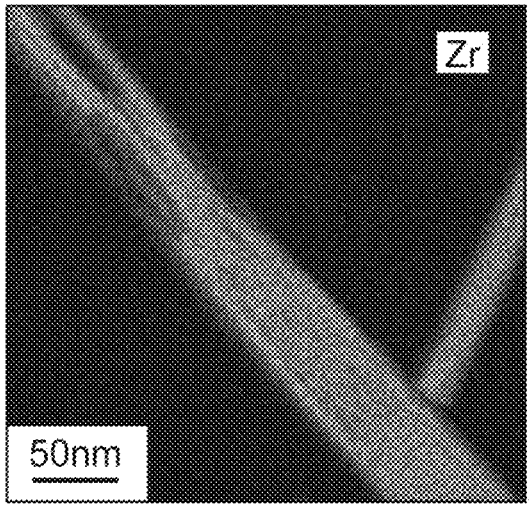
FIG. 4D is a Zr distribution map in the region shown in FIG. 4A.

A Zr distribution map in the region in FIG. 4A is shown in FIG. 4D.

Figure 5A:
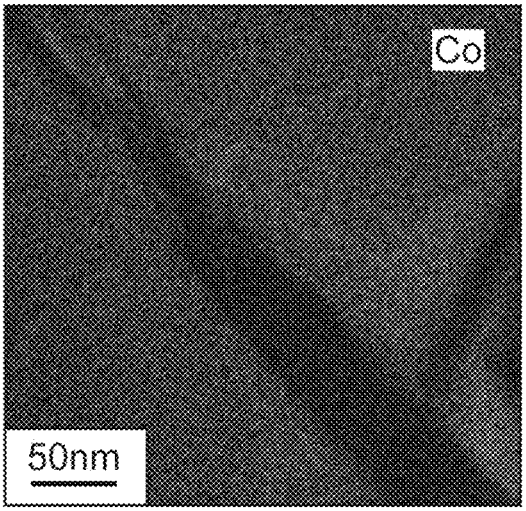
FIG. 5A is a Co distribution map in the region shown in FIG. 4A.

A Co distribution map in the region in FIG. 4A is shown in FIG. 5A.

Figure 5B:
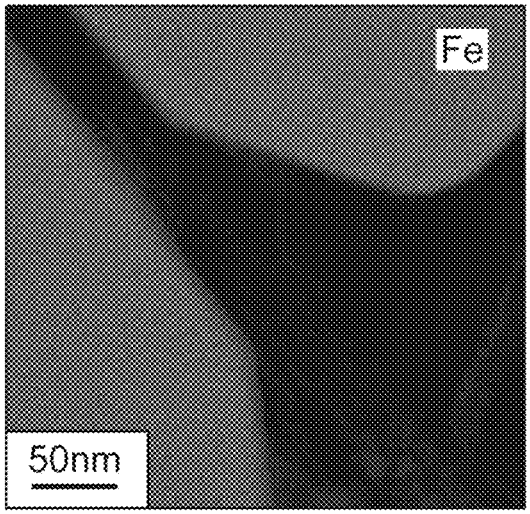
FIG. 5B is an Fe distribution map in the region shown in FIG. 4A.

An Fe distribution map in the region in FIG. 4A is shown in FIG. 5B.

Figure 5C:
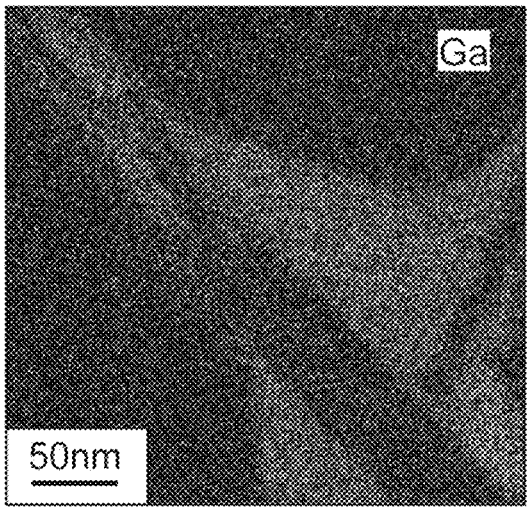
FIG. 5C is a Ga distribution map in the region shown in FIG. 4A.

A Ga distribution map in the region in FIG. 4A is shown in FIG. 5C.

Figure 5D:
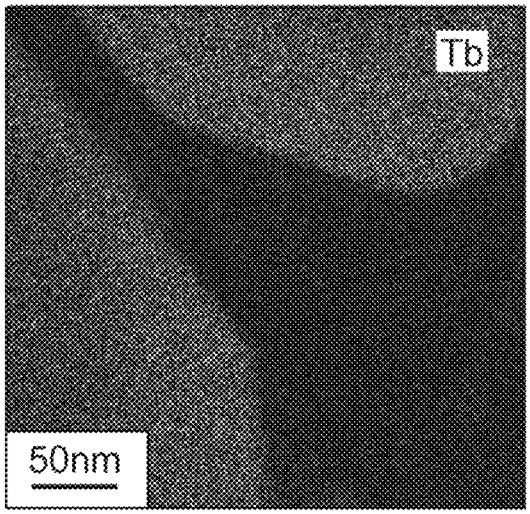
FIG. 5D is a Tb distribution map in the region shown in FIG. 4A.

A Tb distribution map in the region in FIG. 4A is shown in FIG. 5D.

In mapping using STEM-EDS, a characteristic X-ray energy region of Zr and a characteristic X-ray energy region of B overlapped each other, and detection sensitivity of B was not sufficient, and thus it was difficult to detect B.

The above-described analysis result showed that the permanent magnet of Example 1 has the following characteristics.

As shown in FIG. 4A, the grain boundary phase 4-1 was composed of a plate-like crystal 3 and an R—Cu-rich phase 5 including Nd, Pr, and Cu. A region in which Zr was distributed approximately completely matched a position of the plate-like crystal 3. The R—Cu-rich phase 5 existed around the plate-like crystal 3. The R—Cu-rich phase 5 existed between the plate-like crystal 3 and the main phase grain 4. The plate-like crystal 3 was connected to the two-grain boundary. A total concentration of Nd and Pr in the one Zr—B—Cu grain boundary containing both the plate-like crystal 3 and the R—Cu-rich phase 5 was higher than a total concentration of Nd and Pr in the main phase grain 4. A concentration of Cu in the one Zr—B—Cu grain boundary containing both the plate-like crystal 3 and the R—Cu-rich phase 5 was higher than a concentration of Cu in the main phase grain 4. A surface layer part of the main phase grain 4 included Tb.

Figure 6A:
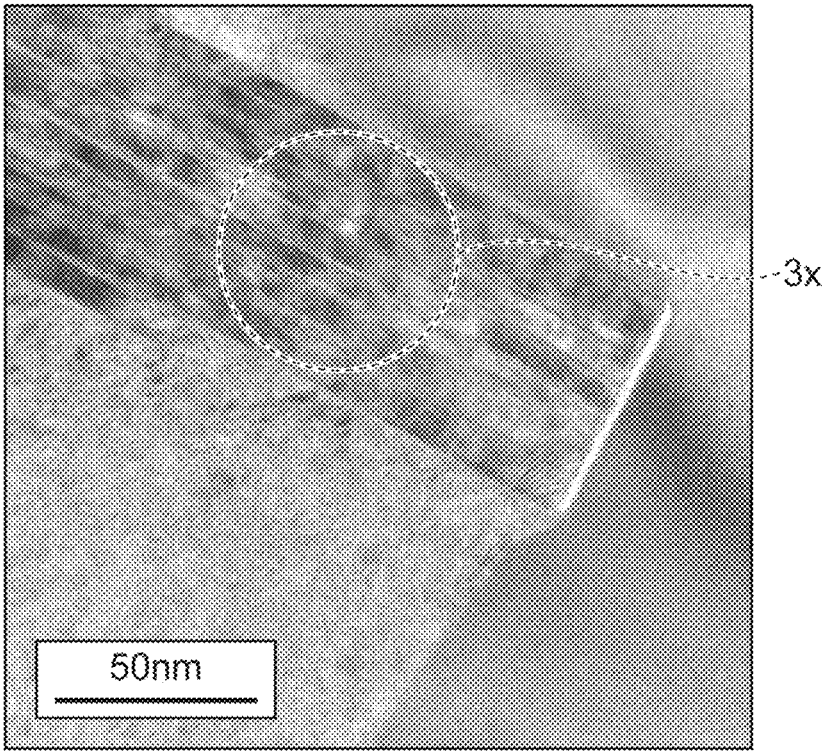
FIG. 6A is an image of the $ZrB_2$ crystal.
Figure 6B:
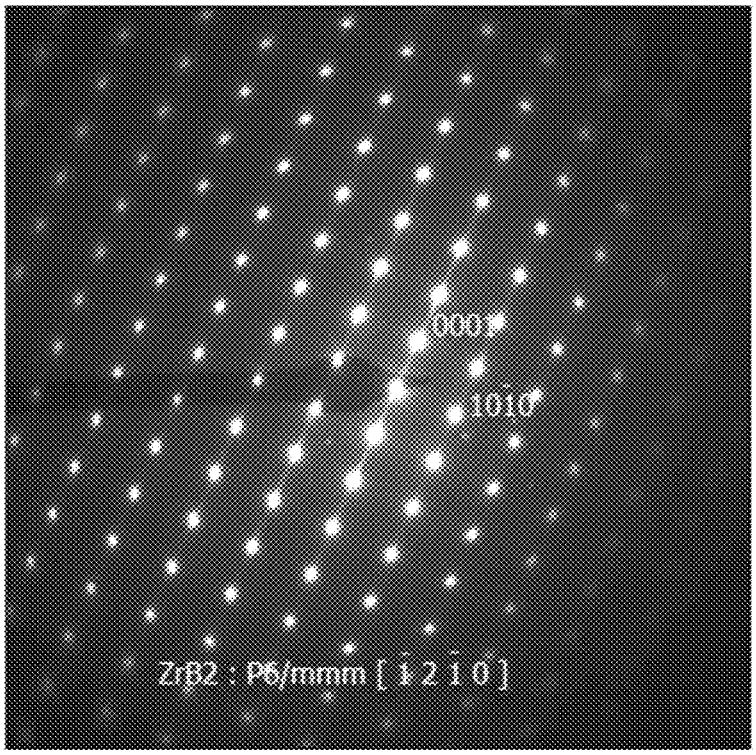
FIG. 6B is an electron beam diffraction pattern of the $ZrB_2$ crystal shown in FIG. 6A.

The HAADF-STEM image of the plate-like crystal 3 contained in the grain boundary phase 4-1 is shown in FIG. 6A. An electron beam diffraction pattern was measured in a region 3*x* in the plate-like crystal 3 shown in FIG. 6A. The measured electron beam diffraction pattern is shown in FIG. 6B. A lattice constant and symmetry of the plate-like crystal 3 specified from the electron beam diffraction pattern matched a lattice constant and symmetry of hexagonal $ZrB_2$. One Zr—B—Cu grain boundary contained in the grain boundary phase 4-1 contained both the $ZrB_2$ crystal and the R—Cu-rich phase.

As in the sample containing the grain boundary phase 4-1, four samples containing a grain boundary phase 4-2, a grain boundary phase 4-3, a grain boundary phase 4-4, and a grain boundary phase 4-5, respectively, were produced. Each of the samples was analyzed by the same method as in the sample containing the grain boundary phase 4-1. The analysis results showed that each of the grain boundary phase 4-2, the grain boundary phase 4-3, the grain boundary phase 4-4, and the grain boundary phase 4-5 has the same characteristics as in the grain boundary phase 4-1. That is, each of the grain boundary phase 4-2, the grain boundary phase 4-3, the grain boundary phase 4-4, and the grain boundary phase 4-5 contained both the $ZrB_2$ crystal and the R—Cu-rich phase.

Comparative Example 1

In Comparative Example 1, a diffusing material B produced by the following method was used instead of the diffusing material A.

The fine powder (third component) consisting of the Tb hydride, an alcohol (solvent), and an acrylic resin (binder) were kneaded to produce a paste-like diffusing material B. That is, the diffusing material B did not contain the fine powder (first component) consisting of the Nd hydride, and the fine powder (second component) consisting of the Cu simple substance. A mass ratio of the third component in the diffusing material B was 75.0 parts by mass. A mass ratio of the solvent in the diffusing material B was 23.0 parts by mass. A mass ratio of the binder in the diffusing material B was 2.0 parts by mass.

A permanent magnet of Comparative Example 1 was produced by the same method as in Example 1 except that the diffusing material B was used. A content of each element in the permanent magnet of Comparative Example 1 is shown in the following Table 1.

Br and HcJ of the permanent magnet of Comparative Example 1 were measured by the same method as in Example 1. Br and HcJ of Comparative Example 1 are shown in the following Table 1. It was confirmed that the coercivity of the permanent magnet of Example 1 at 160° C. was higher than the coercivity of the permanent magnet of Comparative Example 1 at 160° C.

A cross-section of the permanent magnet of Comparative Example 1 was analyzed by the same method as in Example 1. Analysis results of Comparative Example 1 are shown in the following Table 3. A composition of each of a grain boundary phase 1, a grain boundary phase 2, a grain boundary phase 3, and a grain boundary phase 4-1 shown in the following Table 3 corresponds to one grain boundary multiple junction. The permanent magnet of Comparative Example 1 contained a plurality of main phase grains including Nd, Fe, Co, and B, and a plurality of grain boundary multiple junctions. A grain boundary multiple junction (grain boundary phase 4-1) where high-concentration sites of each of Zr and B overlap each other was detected in the permanent magnet of Comparative Example 1. However, a grain boundary multiple junction (Zr—B—Cu grain boundary) where high-concentration sites of each of Zr, B, and Cu overlap each other was not detected in the permanent magnet of Comparative Example 1. That is, in the case of Comparative Example 1, a concentration of Cu in the grain boundary multiple junction where the high-concentration sites of each of Zr and B overlap each other was not higher than a concentration of Cu in another grain boundary multiple junction.

TABLE 1

| | Content of each element (% by mass) | | | | | | | | | | | Br | HcJ |
|---|---|---|---|---|---|---|---|---|---|---|---|---|---|
| | Nd | Pr | Dy | Tb | Co | Cu | Al | Ga | Zr | B | Fe | (mT) | (kA/m) |
| Magnet base material | 30.4 | 0.1 | 0.0 | 0.0 | 0.5 | 0.05 | 0.2 | 0.08 | 0.4 | 0.95 | balance | — | — |
| Permanent magnet of Example 1 | 30.4 | 0.1 | 0.0 | 0.4 | 0.5 | 0.25 | 0.2 | 0.08 | 0.4 | 0.95 | balance | 1431 | 780 |
| Permanent magnet of Comparative Example 1 | 30.4 | 0.1 | 0.0 | 0.4 | 0.5 | 0.05 | 0.2 | 0.08 | 0.4 | 0.95 | balance | 1433 | 736 |

TABLE 2

| | Concentration of each element (atomic %) | | | | | | | | | | |
|---|---|---|---|---|---|---|---|---|---|---|---|
| | Nd + Pr | Tb | Fe | B | Al | Co | Cu | Ga | Zr | C | O |
| Main phase grain | 11.2 | 0.0 | 74.7 | 4.4 | 0.7 | 0.6 | 0.0 | 0.0 | 0.2 | 7.5 | 0.7 |
| Grain boundary phase 1 | 77.2 | 0.3 | 5.4 | 0.0 | 0.2 | 0.5 | 0.0 | 0.0 | 0.0 | 14.3 | 2.1 |
| Grain boundary phase 2 | 44.2 | 3.8 | 1.9 | 0.0 | 0.2 | 0.0 | 0.0 | 0.0 | 0.0 | 24.7 | 25.2 |
| Grain boundary phase 3 | 37.0 | 0.7 | 34.5 | 0.3 | 1.7 | 3.2 | 7.6 | 1.6 | 0.2 | 11.0 | 2.2 |
| Grain boundary phase 4-1 | 29.2 | 0.5 | 16.7 | 13.6 | 0.9 | 1.3 | 17.0 | 1.6 | 2.7 | 14.7 | 1.8 |
| Grain boundary phase 4-2 | 29.6 | 0.7 | 20.1 | 10.2 | 1.5 | 1.7 | 14.2 | 1.5 | 6.5 | 12.6 | 1.4 |
| Grain boundary phase 4-3 | 46.1 | 0.2 | 11.4 | 8.4 | 0.5 | 4.9 | 11.8 | 1.1 | 3.2 | 9.9 | 2.5 |
| Grain boundary phase 4-4 | 39.8 | 0.4 | 22.6 | 6.4 | 0.6 | 4.0 | 9.2 | 1.0 | 1.6 | 11.3 | 3.1 |
| Grain boundary phase 4-5 | 25.1 | 0.6 | 11.5 | 15.2 | 1.1 | 2.3 | 19.6 | 1.8 | 7.4 | 13.1 | 2.3 |

TABLE 3

| | Concentration of each element atomic % | | | | | | | | | | |
|---|---|---|---|---|---|---|---|---|---|---|---|
| | Nd + Pr | Tb | Fe | B | Al | Co | Cu | Ga | Zr | C | O |
| Main phase grain | 11.1 | 0.0 | 74.1 | 4.4 | 0.7 | 0.6 | 0.0 | 0.0 | 0.2 | 8.2 | 0.7 |
| Grain boundary phase 1 | 71.3 | 0.3 | 9.3 | 0.0 | 0.3 | 0.4 | 0.0 | 0.0 | 0.0 | 15.2 | 3.2 |
| Grain boundary phase 2 | 46.0 | 3.4 | 0.5 | 0.0 | 0.0 | 0.0 | 0.0 | 0.0 | 0.0 | 24.6 | 25.5 |

TABLE 3-continued

| | Concentration of each element atomic % | | | | | | | | | | |
|---|---|---|---|---|---|---|---|---|---|---|---|
| | Nd + Pr | Tb | Fe | B | Al | Co | Cu | Ga | Zr | C | O |
| Grain boundary phase 3 | 31.5 | 0.6 | 33.8 | 0.4 | 1.9 | 2.7 | 2.7 | 5.9 | 0.1 | 14.9 | 5.5 |
| Grain boundary phase 4-1 | 69.6 | 0.2 | 8.4 | 5.6 | 0.4 | 0.5 | 0.0 | 0.0 | 2.6 | 9.7 | 3.0 |

INDUSTRIAL APPLICABILITY

The R-T-B permanent magnet according to an aspect of the invention is appropriate for, for example, a material of a motor equipped in a hybrid vehicle or an electric vehicle.

REFERENCE SIGNS LIST

2: permanent magnet, 2*cs*: cross-section of permanent magnet, 3: $ZrB_2$ crystal, 4: main phase grain, 4*a*: surface layer part (shell), 4*b*: center part (core), 5: R—Cu-rich phase, 6: grain boundary multiple junction, 10: two-grain boundary.

What is claimed is:

1. An R-T-B based permanent magnet including a rare-earth element R, a transition metal element T, B, Zr, and Cu, wherein the R-T-B based permanent magnet includes at least Nd as R, the R-T-B based permanent magnet includes at least Fe as T, the R-T-B based permanent magnet comprises a plurality of main phase grains including Nd, T, and B, and a plurality of grain boundary multiple junctions, each one of the grain boundary multiple junctions is a grain boundary surrounded by three or more of the main phase grains, at least one of the grain boundary multiple junctions contains both a $ZrB_2$ crystal and an R—Cu-rich phase including R and Cu, which includes at least Nd as R, a concentration of B in the at least one of the grain boundary multiple junctions which contains both the $ZrB_2$ crystal and the R—Cu-rich phase is from 5 to 20 atomic %, a concentration of Cu in the at least one of the grain boundary multiple junctions which contains both the $ZrB_2$ crystal and the R—Cu-rich phase is from 5 to 25 atomic %, and a surface layer part of at least one of the main phase grains includes at least one kind of heavy rare-earth element among Tb and Dy.

2. The R-T-B based permanent magnet according to claim 1, wherein a concentration of Zr in the one grain boundary multiple junction containing both the $ZrB_2$ crystal and the R—Cu-rich phase is from 1 to 10 atomic %.

3. The R-T-B based permanent magnet according to claim 1, wherein a total concentration of Nd and Pr in the one grain boundary multiple junction containing both the $ZrB_2$ crystal and the R—Cu-rich phase is from 20 to 70 atomic %.

4. The R-T-B based permanent magnet according to claim 1, wherein the R—Cu-rich phase exists around the $ZrB_2$ crystal.

5. The R-T-B based permanent magnet according to claim 1, wherein the R—Cu-rich phase exists between the $ZrB_2$ crystal and the main phase grain.

6. The R-T-B based permanent magnet according to claim 1, wherein some of the grain boundary multiple junctions contain a T-rich phase including T, Cu, and at least one kind of R among Nd and Pr, which includes at least Fe as T, a concentration of T in the grain boundary multiple junction containing the T-rich phase is higher than a concentration of T in the other grain boundary multiple junction, and a unit of the concentration of T is atomic %.

* * * * *